United States Patent [19]

Hayano et al.

[11] Patent Number: 4,708,607

[45] Date of Patent: Nov. 24, 1987

[54] SCROLL COMPRESSOR WITH LOWER AND HIGHER PRESSURE CHAMBERS ACTING ON THE ORBITING END PLATE

[75] Inventors: Makoto Hayano; Shigemi Nagatomo, both of Tokyo; Hirotsugu Sakata, Chigasaki; Mitsuo Hatori, Yokohama; Hitoshi Hattori, Yokosuka, all of Japan

[73] Assignee: Kabushiki Kaisha Toshiba, Kawasaki, Japan

[21] Appl. No.: 942,916

[22] Filed: Dec. 18, 1986

Related U.S. Application Data

[63] Continuation of Ser. No. 725,332, Apr. 19, 1985, abandoned.

[30] Foreign Application Priority Data

Jul. 20, 1984 [JP] Japan ..... 59-150817

[51] Int. Cl.[4] ..... F04C 18/04

[52] U.S. Cl. ..... 418/55; 418/57

[58] Field of Search ..... 418/55, 57; 417/902

[56] References Cited

U.S. PATENT DOCUMENTS

| | | | |
|---|---|---|---|
| 3,011,694 | 12/1961 | Audemar | 418/55 |
| 3,884,599 | 5/1975 | Young et al. | 418/55 |
| 3,994,633 | 11/1976 | Shaffer | 418/5 |
| 4,065,279 | 12/1977 | McCullough | 62/510 |
| 4,431,388 | 2/1984 | Eber et al. | 418/55 |
| 4,494,914 | 1/1985 | Shiibayashi | 418/55 |
| 4,496,296 | 1/1985 | Arai et al. | 418/55 |
| 4,522,575 | 6/1985 | Tischer et al. | 418/57 |
| 4,552,518 | 11/1985 | Utter | 418/55 |
| 4,585,403 | 4/1986 | Inaba et al. | 418/55 |

FOREIGN PATENT DOCUMENTS

| | | | |
|---|---|---|---|
| 59-103980 | 6/1984 | Japan | 418/57 |

*Primary Examiner*—John J. Vrablik

*Attorney, Agent, or Firm*—Schwartz, Jeffery, Schwaab, Mack, Blumenthal & Evans

[57] ABSTRACT

In a scroll compressor, the side of the orbiting end plate away from the compression chambers is slidably supported by an annular protusion formed in the frame. A lower pressure chamber is formed on the radially outer side of this annular protrusion, and an Oldham's ring is fitted inside the lower pressure chamber.

7 Claims, 4 Drawing Figures

SCROLL COMPRESSOR WITH LOWER AND HIGHER PRESSURE CHAMBERS ACTING ON THE ORBITING END PLATE

This application is a continuation of application Ser. No. 725,332 filed Apr. 19, 1985, abandoned.

TECHNOLOGICAL FIELD OF THE INVENTION

This invention relates to a scroll compressor. More specifically, it relates to a higher pressure-type scroll compressor in which the rotation resistance during relative rotation between the stationary end plate and the orbiting end plate and the sliding friction of the Oldham's ring provided on the orbiting end plate during operation have been reduced.

TECHNOLOGICAL BACKGROUND OF THE INVENTION

A scroll compressor comprises two disk-like end plates, each having a spiral wrap at one side thereof, facing each other. The two wraps are in contact along several contact lines, forming a plurality of compressor chambers therebetween. In the scroll compressor, one end plate revolves around the other stationary end plate in an eccentric orbit, so that the contact lines gradually shift from the outer circumference toward the inner circumference. The gas that is drawn into the compression chambers between the two wraps is gradually compressed from the outer circumference toward the inner circumference.

There are basically two types of scroll compressor: a lower pressure type, in which the inside of the vessel is maintained at lower pressure, as in U.S. Pat. Nos. 3,011,694 and 4,065,279, and a higher pressure type, in which there is a higher pressure chamber on the opposite side to the compression chamber of the orbiting end plate, as in U.S. Pat. Nos. 3,884,599 and 3,994,633.

In general, in a higher pressure type scroll compressor, a rotation drive device such as a motor and a compression device to compress the gas are installed inside a sealed vessel. The gas (such as air) to be compressed passes through a guide tube which is inserted into the sealed vessel, and enters the compression chamber from one or more inlets on the outer circumference of the compressor. After the compressed gas at a high pressure from the compression chamber has passed through each part of the interior of the sealed vessel, it is exhausted out of the sealed vessel to the outside. That is to say, high-pressure gas which has left the compression chambers between the pair of stationary and orbiting end plates passes around to a first surface, that is, the surface opposite the compression chamber, of the orbiting end plate and a strong force then act on the other stationary end plate.

Consequently, the friction force between the two end plates becomes large, generating heat, and an increase of the drive input becomes necessary. For this reason, heat is again generated by friction, causing the problem that the intake gas is heated before it is drawn in the compression chambers from the intake ports. Also, in a higher pressure type scroll compressor, since the inside of the sealed vessel is at high pressure, the gas density becomes large, causing the problem that large resistance is produced when the Oldham's ring reciprocates between the orbiting end plate and the frame for supporting the end plates inside the sealed vessel.

The lower pressure type is used in small compressors and the end plates used in them are thin, but in the higher pressure type the end plates are thick and inflexible so that they cause a problem with the sealing during operation. A number of methods have been tried to deal with this problem. However, it has never been suggested to use the higher-pressure type in a small compressor and to build a lower-pressure chamber into the higher-pressure chamber.

PURPOSES OF THE INVENTION

The first purpose of this invention is to provide a scroll compressor in which the force of the orbiting end plate pressing against the stationary end plate can be made small.

The second purpose of this invention is to provide a scroll compressor in which the resistance to reciprocating motion of the Oldham's ring which fits between the orbiting end plate and the frame inside the sealed vessel is small.

SUMMARY OF THE INVENTION

This invention to achieve its objectives has three features. The first feature is that the first surface or back surface, that is to say, the surface away from the compression chamber, of the orbiting end plate is slidably supported by an annular protrusion formed on the frame. The second feature is that a lower pressure chamber is formed on the radially outer side of this annular protrusion, and an Oldham's ring is fitted inside the lower-pressure chamber.

The third feature is that gas is fed directly into the lower pressure chamber to pass the gas from the lower-pressure chamber to the compression chambers.

BRIEF DESCRIPTION OF THE DRAWINGS

These and other aspects and advantages of the invention will become apparent by reference to the following detailed description of preferred embodiments when considered in conjunction with the accompanying drawing, wherein like numerals correspond to like elements throughout the drawing.

DESCRIPTION OF PREFERRED EMBODIMENTS

Figure 1:
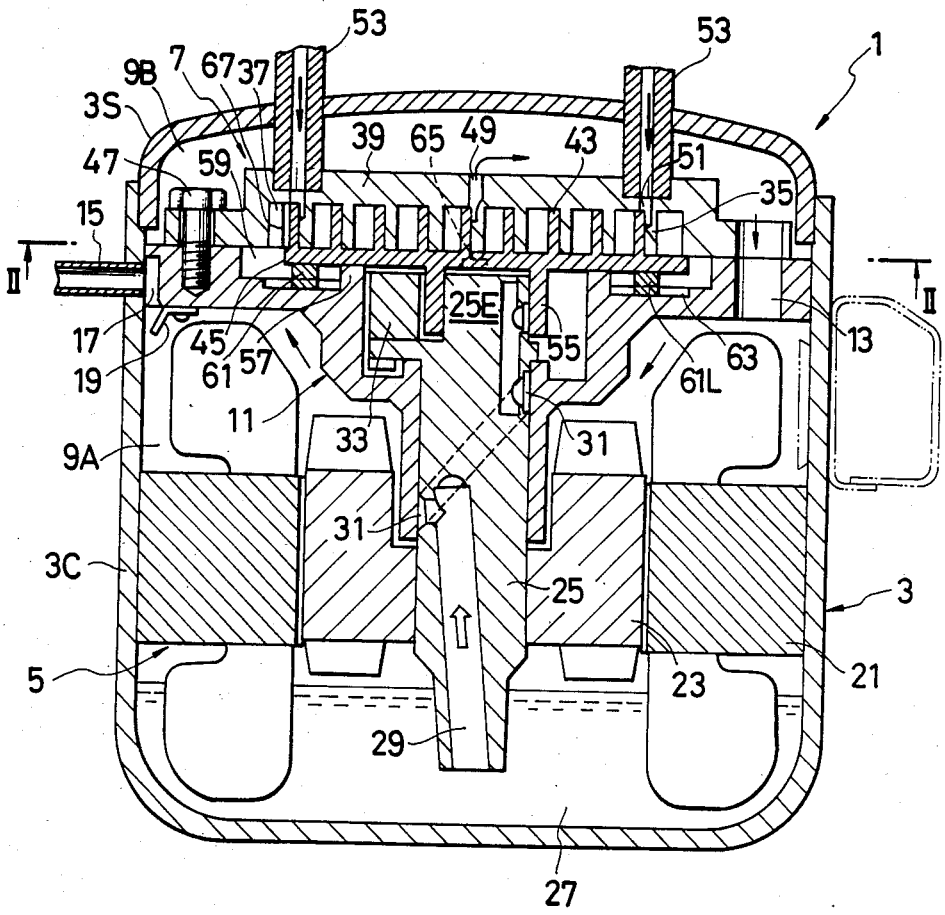
FIG. 1 is a front cross-sectional view of a scroll compressor according to the present invention.

Referring to FIG. 1, the scroll compressor 1 comprises a sealed vessel 3, a rotation drive device 5, such as a motor, installed inside the sealed vessel 3, and a compression device 7 which compresses gas.

The sealed vessel 3 consists of a bottomed cylindrical casing 3C and a seal cover 3S which is sealingly fixed to the casing 3C. Integrally fixed to the inside of the sealed vessel 3 is a substantially disc-shaped frame 11 that divides the interior of the sealed vessel 3 into a drive chamber 9A and a compression device chamber 9B. Pierced in this frame 11 is at least one through-hole 13 which communicates the drive chamber 9A with the compression device chamber 9B. In addition, formed at a location remote from the through-hole 13 is a recessed communicating path 17 which communicates the drive chamber 9A with the exhaust tube 15 mounted to the pressure vessel 3. Disposed near the entrance to this communicating path 17 is a baffle plate 19 which interferes with the direct flow-out of high-pressure gas mixed with oil from the drive chamber 9A to the exhaust tube 15. Also, as the high pressure gas contacts this baffle plate, lubrication oil mixed into the gas adheres to the plate and is separated out from the gas.

The rotation drive device 5 consists of a motor in this embodiment. The stator iron core 21 is integrally mounted to the casing 3C in the drive chamber 9A. The rotor 23 is integrally mounted to the rotating shaft 25 which is supported vertically in the center of the said frame 11. The lower end of the rotating shaft 25 is immersed in the lubricating oil 27 which accumulates in the bottom of the casing 3C. The core of this rotating shaft 25 has a lubricating oil suction hole 29, which sucks up the lubricating oil 27 when the shaft 25 rotates. It will be noted from the drawing that the hole 29 is inclined at a suitable angle to the shaft core. This suction hole 29 is connected to several supply ports 31 at bearing portions where the rotating shaft 25 is supported by the frame 11. In this particular embodiment, the suction hole 29 is inclined, but it can also have another orientation provided that it has a flow path in the radial direction. Formed at the top end of the rotating shaft 25 is the eccentric section 25E which has a suitable eccentricity with respect to the core of the rotating shaft 25. In addition, a balance 33 is mounted off center to maintain equilibrium with the eccentric section 25E and other parts to reduce vibrations.

In the configuration mentioned above, when the rotating shaft 25 rotates, lubricating oil is automatically supplied to the bearing portions where the shaft is supported and other locations where it is needed, so that smooth motion is maintained.

The compression device 7 is positioned inside the compression device chamber 9B, and comprises a disc-shaped stationary end plate 39 which has a first or stationary scroll wrap 35 and a semicircularly shaped suction chamber 37 including the outermost part of the compression chambers; and a disc-shaped orbiting end plate 45 which has a second or orbiting scroll wrap 43, which slidably contacts the first or stationary scroll wrap 35 in several places, forming compression chambers 41. The rotating shaft 25 is attached to the first surface, that is to say the surface away from the compression chambers, of this orbiting end plate 45.

The stationary end plate 39 is fixed tightly to the frame 11 by several bolts 47. Pierced in the center of this stationary end plate 39 is an ejection port or discharge port 49 through which compressed gas at higher pressure is ejected into the compression device chamber 9B. Also, at a location corresponding to the outermost part of the compression chambers 41 formed by the combination of the first scroll wrap 35 or the stationary end plate 39 with the second scroll wrap 43, there is at least one suction port 51 opening on the first surface, that is to say the surface on the compression chamber side, of the stationary end plate 39 so as to draw the gas. A suction tube 53 is connected from the second surface, that is to say the surface away from the compression chambers, of the stationary end plate 39 to this suction port 51. The suction port 51 is partly defined by a notch or recess cut into a portion of the first scroll wrap 35.

In this embodiment, in order to give the whole construction of the compression chambers point symmetry and to increase the efficiency of compression, suction ports 51 are opened in two symmetrical locations, but it is possible to have only one suction port or a number of suction ports or even an asymmetrical arrangement of suction ports.

The orbiting end plate 45 mentioned above is formed integrally with the second scroll wrap 43, which contacts the first scroll wrap 35 at several locations so that the two are free to slide against each other. Thus the orbiting end plate 45 is combined with the stationary end plate 39 to form compression chambers 41 at several locations between the first surface of the stationary end plate and the second surface of the orbiting end plate, as shown in FIG. 1.

In the center of the first surface of the orbiting end plate 45, a cylindrically-shaped mating section 55 is formed. The eccentric section 25E of the rotating shaft 25 is rotatably mated to the inside of this mating section 55. In addition, the first surface of the orbiting end plate 45 is rotatably supported on the tip of an annular protrusion 57 formed on the frame 11. A lower pressure chamber 59 is formed on the outside of the protrusion (rigid frame portion) 57 in such a way that it is communicated with the suction chamber 37. An Oldham's ring 61 is fitted inside this lower pressure chamber 59. Since the Oldham's ring moves in an environment of relatively lower density, the resistance acting on it is small.

When the orbiting end plate 45 revolves, the Oldham's ring 61 acts to keep the orbiting end plate 45 in a constant orientation with respect to the stationary end plate 39. A downward protrusion 61L is formed in the lower surface of the Oldham's ring 61 to extend in the radial direction, while an upward protrusion (not shown in the figure) is formed on the upper surface of the ring 61 to extend in the direction perpendicular to the downward protrusion 61L. This downward protrusion 61L on the Oldham's ring 61 is slidably mated to the guide groove 63 formed in the bottom of the lower pressure chamber 59. The upward protrusion is slidably mated to the guide groove 65 formed in the first surface of the orbiting end plate 45. As will be explained below, this causes the second scroll wrap to move in such a way that the rotation of the orbiting end plate 45 compresses the gas that has been drawn in.

Figure 2A:
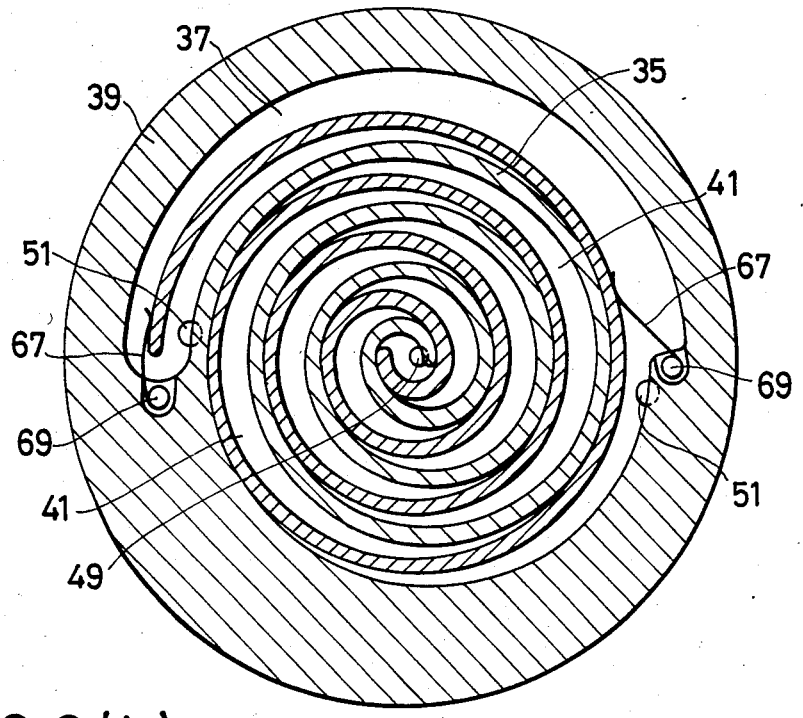
FIGS. 2(*a*) and (*b*) are cross-sectional views taken along the line II—II in FIG. 1 at different instances of operation and are used to explain the action.
Figure 2B:
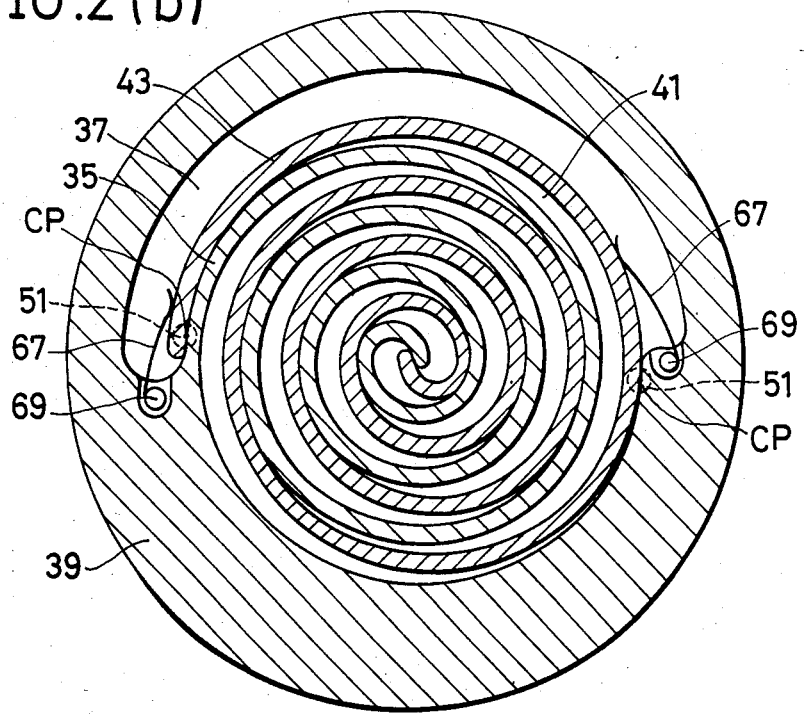

In addition, as is shown best in FIGS. 2(*a*) and (*b*), near the suction port 51 there is a guide valve or baffle 67 to guide the gas drawn in from the suction port 51 in the direction of the compression chambers 41. The guide valve 67, in this embodiment, consists of a leaf spring having a width nearly equal to the width of the orbiting scroll wrap 43, and has its base supported by the fixed end plate 39 through the pin 69 with its tip pressed up against the orbiting scroll wrap 43.

Since the orbiting end plate is rotated in an orbiting manner with its position changing relative to the stationary end plate, as shown in FIGS. 2(*a*) and (*b*), fluid moves into the lower pressure chamber via the gap between the guide valve 67 and the "second surface" of the orbiting end plate 45. Because the guide valve 67 does not completely reach the orbiting end plate 45, a gap exists for entry of fluid into the lower pressure chamber 59.

In the configuration described above, when the rotating shaft 25 is rotated by the rotation drive device 5, the eccentric section 25E of the rotating shaft 25 rotates eccentrically. Consequently, the orbiting end plate 45 is caused to revolve while its orientation is held constant by the Oldham's ring 61. The scroll wrap 43 attached to the orbiting end plate 45 is displaced in the up, down, left and right directions in FIGS. 2(*a*) and (*b*). At this time, when the second scroll wrap 43 is caused to rotate in the clockwise direction in FIGS. 2 (*a*) and (*b*), the multiple contact lines CP between the first scroll wrap 35 of the stationary end plate 39 and the second scroll wrap 43 of the orbiting end plate 45 move gradually from the outer circumference as shown FIGS. 2(*a*) and (*b*), causing the compression chambers 41 to gradually compress. Consequently, the gas inside the compression chambers 41 is compressed, and ejected from the discharge port 49 into the compression device chamber 9B.

The higher pressure gas ejected into the compression device chamber 9B passes through the through hole 13 into the drive chamber 9A and then is exhausted to the outside from the exhaust tube 15. At this time, the higher pressure gas contacts the baffle plate 19, and the oil contained in the gas is removed by adhering to the baffle plate before it is exhausted to the outside.

As explained above, when the drive device 5 causes the orbiting end plate 45 to revolve, compressing the gas, gas is drawn in from the suction port 51 through the suction tube 53. Since the suction port 51 is formed so that its diameter is relatively large, the flow path resistance becomes small and gas is effectively drawn in.

Since gas flows into the compression chambers 41 directly from the suction port 51, the gas is not heated, increasing the compression efficiency and the volume efficiency. Also, a small part of the gas which is drawn in from the suction port 51 flows into the lower pressure chamber 59 to maintain the lower pressure in the lower pressure chamber 59, while the larger part of the gas is guided by the guide valve 67 to the compression chamber 41, maintaining highly efficient suction and compression.

Since, as explained above, the high pressure gas is ejected into the sealed vessel 3, this high pressure gas within the sealed vessel 3 acts on the first or rear surface of the orbiting end plate 45. However, in this embodiment, since the first surface of the orbiting end plate 45 is mated with and supported by the annular protrusion 57 formed on the frame 11 so as to form the lower pressure chamber 59 on the radially outside of the protrusion 57, high pressure acts on the orbiting end plate only on the inside of the protrusion 57. Consequently, the force pressing the orbiting end plate 45 against the stationary end plate 39 becomes small, and the orbiting end plate 45 can revolve smoothly.

The pressure inside the compression chamber 41 tends to separate the orbiting end plate 45 from the stationary end plate 39. That force is distributed such that it is larger in the center than at the outer circumference of the orbiting end plate 45. It is desirable for this force distribution to be considered in determining the diameter of the said protrusion 57.

When the orbiting end plate 45 is caused to revolve as described above, the Oldham's ring 51 reciprocates in the direction along the guide groove 63. Since the Oldham's ring 61 is placed inside the lower pressure chamber 59, the loss due to air resistance against the reciprocating motion is decreased, and mechanical efficiency is increased, as compared to the case in which the Oldham's ring 61 is set inside the higher pressure chamber.

Figure 3:
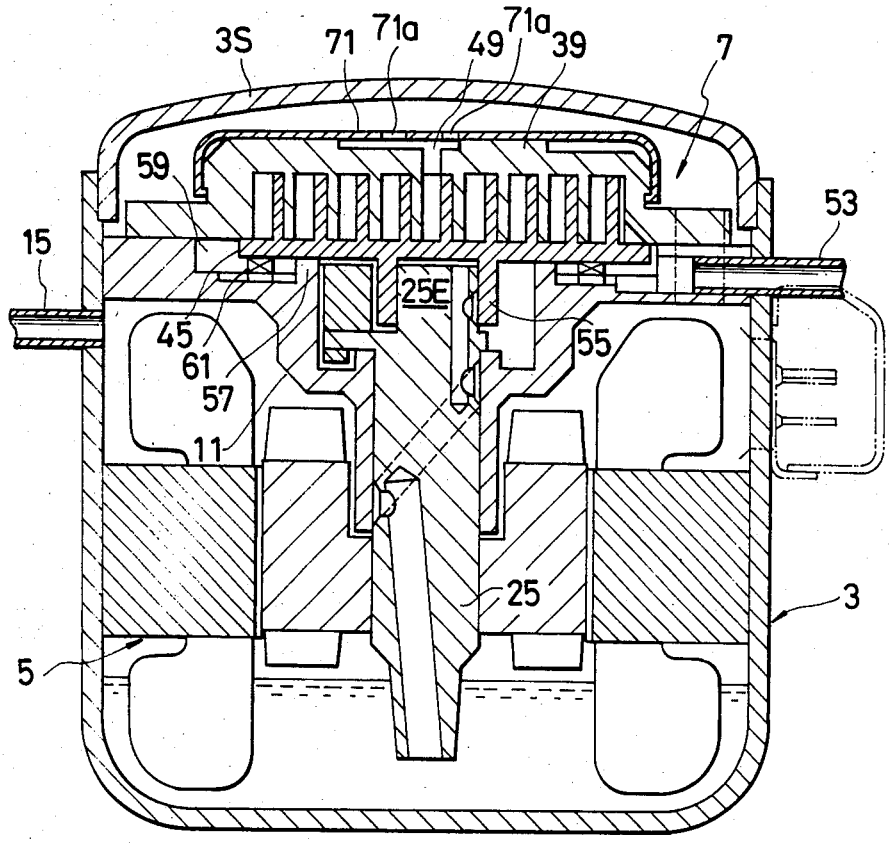
FIG. 3 is a frontal cross-sectional diagram of another embodiment of this invention.

FIG. 3 shows another embodiment of this invention. In this embodiment, the location where the exhaust tube 15 is installed is changed so that the communicating path 17 is eliminated. In addition the suction tube 53 is connected to the lower pressure chamber 59, and gas is drawn in through the lower pressure chamber 59. Also, in this embodiment, a cover plate 71 having openings 71*a* is attached to the stationary end plate 39 to suppress the noise made when higher pressure gas is ejected from the ejection port 49, while at the same time preventing the higher pressure gas from directly striking the sealing cover 3S. Other than these changes the configuration is the same as in the previous embodiment. Consequently, further details need not be explained again. Also, in this embodiment the invention has the same effectiveness as in the previous embodiment.

While preferred embodiments of this invention have been shown and described, it will be appreciated that other embodiments will become apparent to those skilled in the art upon reading this disclosure, and, therefore, the invention is not to be limited by the disclosed embodiments.

We claim:

1. A scroll compressor comprising:

a sealed vessel;

a frame disposed inside said sealed vessel to rotatably support a rotating shaft and to partition the interior of the sealed vessel into a drive chamber and a compression device chamber;

a stationary end plate which has an outer wall, a first scroll wrap on the inside of said outer wall, and a means for tightly fixing said stationary end plate to said frame inside said pressure vessel;

an orbiting end plate having a first surface thereof connected to a rotating shaft, and a second scroll wrap which is slidable against said first scroll wrap at a plurality of places so as to form compression chambers between said stationary end plate and a second surface opposite to said first surface of the orbiting end plate;

an Oldham's ring operatively disposed between said orbiting end plate and said frame;

said frame formed with a rigid annular frame portion for slidably supporting said orbiting end plate on said first surface thereof such that said rigid annular frame portion seals the space radially inside said rigid frame portion from that radially outside said rigid frame portion, said rigid frame portion disposed radially inside of said Oldham's ring and extending axially so as to limit axial loading upon said Oldham's ring from said orbiting plate;

said stationary end plate formed with a suction port at a relatively outer periphery portion thereof corresponding to the outermost part of said compression chambers and a discharge port substantially in the center thereof;

and means for communicating higher pressure fluid exhausted from said compression chambers to said space radially inside said rigid frame portion;

wherein fluid entering said suction port is compressed in said compressor chambers to a higher pressure as said orbiting scroll rotates, and said first surface of said orbiting end plate, in a space radially inside said rigid frame portion, is exposed to said higher pressure fluid exhausted from said compression chambers to provide additional support to said orbiting plate.

2. A scroll compressor as described in claim 1, wherein the stationary end plate and the orbiting end plate define a lower pressure chamber on the radially outer side of said rigid annular frame portion, which seals said lower pressure chamber against the higher pressure inside said sealed vessel.

3. A scroll compressor as described in claim 2, wherein said Oldham's ring is positioned within said lower pressure chamber to keep the orbiting end plate in a constant orientation.

4. A scroll compressor as described in claim 2, wherein a gas suction tube is connected to said lower pressure chamber.

5. A scroll compressor as described in claim 4, wherein a cover plate is provided on the stationary end plate.

6. A scroll compressor as described in claim 2, wherein the pressure against said rigid annular frame portion generated inside the compression chambers is supported by said means for fixing said stationary end plate to said frame.

7. A scroll compressor as described in claim 2, wherein said suction port provided in the stationary end plate at the position corresponding to the outermost part of said compression chambers is communicated with said lower pressure chamber whereby gas is drawn into the compression chambers from said suction port with part of the gas passed into said lower pressure chamber through the outermost part of said compression chambers.

* * * * *